US009723414B2

(12) United States Patent
Kamkar-Parsi et al.

(10) Patent No.: US 9,723,414 B2
(45) Date of Patent: Aug. 1, 2017

(54) METHOD FOR SIGNAL PROCESSING IN A BINAURAL HEARING DEVICE AND BINAURAL HEARING DEVICE

(71) Applicant: SIVANTOS PTE. LTD., Singapore (SG)

(72) Inventors: Homayoun Kamkar-Parsi, Erlangen (DE); Eghart Fischer, Schwabach (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/191,789

(22) Filed: Jun. 24, 2016

(65) Prior Publication Data

US 2016/0381469 A1 Dec. 29, 2016

(30) Foreign Application Priority Data

Jun. 24, 2015 (DE) ..... 10 2015 211 747

(51) Int. Cl.
*H04R 25/00* (2006.01)

(52) U.S. Cl.
CPC ..... *H04R 25/552* (2013.01); *H04R 25/405* (2013.01); *H04R 25/407* (2013.01); *H04R 25/505* (2013.01); *H04R 2430/01* (2013.01)

(58) Field of Classification Search
CPC .... H04R 25/00; H04R 25/405; H04R 25/407; H04R 25/505; H04R 25/552; H04R 3/005; H04R 2225/55; H04R 2430/01; H04R 2430/20; H04R 2430/23; G10K 2210/3014
See application file for complete search history.

(56) References Cited

U.S. PATENT DOCUMENTS

| | | | | |
|---|---|---|---|---|
| 7,561,701 | B2 | 7/2009 | Fischer | |
| 9,031,271 | B2 | 5/2015 | Pontoppidan | |
| 9,253,581 | B2 | 2/2016 | Aubreville et al. | |
| 2004/0196994 | A1* | 10/2004 | Kates | H04R 25/407 381/320 |
| 2011/0261982 | A1* | 10/2011 | Isozaki | H04R 25/305 381/315 |

(Continued)

FOREIGN PATENT DOCUMENTS

| | | | |
|---|---|---|---|
| DE | 102013207149 | A1 | 11/2014 |
| EP | 1463378 | A2 | 9/2004 |

(Continued)

*Primary Examiner* — Thang Tran
(74) *Attorney, Agent, or Firm* — Laurence A. Greenberg; Werner H. Stemer; Ralph E. Locher

(57) ABSTRACT

A method performs signal processing in a binaural hearing device that has first and second hearing aids with first and second microphones producing first and second signals and with first and second sound generators. The first and second signals ascertain a direction of a main sound source. A deviation in the direction from a frontal direction prompts the hearing aid that is closer to the main sound source to be defined as the local hearing aid and the hearing aid that is more remote from the main sound source to be a remote hearing aid. The local hearing aid, in one frequency band, filters the first signal using an angle-dependent first filter factor, and thus produces a first filtered signal. The first signal, the second signal and/or the direction of the main sound source is used for determining an adaptation coefficient, a first adapted signal and a local directional characteristic.

9 Claims, 8 Drawing Sheets

(56) References Cited

U.S. PATENT DOCUMENTS

| | | | | |
|---|---|---|---|---|
| 2012/0127832 | A1 | 5/2012 | Mejia | |
| 2012/0128163 | A1* | 5/2012 | Moerkebjerg | H04R 25/407 381/23.1 |
| 2013/0170660 | A1* | 7/2013 | Kristensen | H04R 25/305 381/60 |
| 2015/0289065 | A1* | 10/2015 | Jensen | H04R 25/552 381/315 |
| 2016/0073203 | A1* | 3/2016 | Kuriger | H04R 25/43 381/23.1 |
| 2016/0227332 | A1* | 8/2016 | Pedersen | H04R 25/558 |
| 2016/0234610 | A1* | 8/2016 | Jensen | H04R 25/552 |

FOREIGN PATENT DOCUMENTS

| | | | |
|---|---|---|---|
| EP | 2563045 | A1 | 2/2013 |
| EP | 2928210 | A1 | 10/2015 |

* cited by examiner

METHOD FOR SIGNAL PROCESSING IN A BINAURAL HEARING DEVICE AND BINAURAL HEARING DEVICE

CROSS-REFERENCE TO RELATED APPLICATION

This application claims the priority, under 35 U.S.C. §119, of German application DE 10 2015 211 747.2, filed Jun. 24, 2015; the prior application is herewith incorporated by reference in its entirety.

BACKGROUND OF THE INVENTION

Field of the Invention

The invention relates to a method for signal processing in a binaural hearing device having a first hearing aid and a second hearing aid. The first hearing aid has a first microphone for producing a first signal and a first sound generator, and the second hearing aid has a second microphone for producing a second signal and a second sound generator.

A binaural hearing device usually contains one hearing aid per ear of the user, each of the two hearing aids containing a microphone and an electroacoustic transducer for sound generation. The signals picked up by the two microphones can then be used to form a directional characteristic on the basis of their spacing, it being possible for the directional characteristics in the respective output signal that is output to the electroacoustic transducer to be different for both hearing aids so as to attain better spatial perception. In this case, the term microphone used here and below is intended to be understood to mean both an individual microphone, which is then particularly and essentially an omnidirectional microphone, that is to say a single microphone, and a microphone that contains a plurality of single microphones, particularly two single microphones, and that as such already has a directional characteristic through the interconnection of the single microphones, that is to say is a directional microphone. In other words, in the latter case, a hearing aid then has a monaural directional microphone system.

In a conversation situation with multiple interlocutors that surround the user of a hearing device in various directions, it is possible, given a significant noise level in the surroundings, for adaptation of the binaural directional characteristic to contribute to isolating the voice signals from individual interlocutors and hence improve comprehension of the voice signal that comes from a particular target interlocutor for the user of the binaural hearing device. Interfering noise in proximity to the target interlocutor can be reduced in this case in the same way as conversation contributions from other interlocutors if they are identified as not being the relevant useful signal at that moment. This is achieved by virtue of the directional characteristic being oriented in a comparatively narrow angle range, for example with a total angular aperture of 90 degrees or even just 45 degrees, in the frontal direction of the user.

Usually, adaptation of the binaural directional characteristic requires precise knowledge of the position of the target sound source or target interlocutor, or, synonymously, of the exact direction from which the useful signal comes. For operation of hearing devices, it is usually assumed in this case that the position of the target sound source is in the frontal direction, which is to say approximately 0 degrees relative to the line of vision of the user. A binaural directional characteristic with an orientation of 0 degrees and an angular aperture of 90 degrees or even just 45 degrees then suppresses a large proportion of the background noise, which first of all improves the signal-to-noise ratio for the useful signal coming from the target interlocutor. Furthermore, voice signals from other interlocutors outside the angle range in which the directional characteristic has a high sound sensitivity are also suppressed as appropriate. Such a hearing situation, which is generally referred to as a "cocktail party situation", can arise for a user of a hearing device whenever a conversation is to be held in the presence of other people who are themselves holding conversations with one another.

In a normal conversation situation, the interlocutor makes small movements that may be in an angle range of up to 10 or even up to 20 degrees. Similarly, the user of the binaural hearing device may also make natural head movements by virtue of his gestures in a conversation, which head movements can lead to similar angular deviations in his frontal direction relative to the interlocutor. These movements can noticeably attenuate the voice signal from the interlocutor in the conversation on account of the narrow angular aperture of the directional characteristic. Since particularly head movements by the user of the binaural hearing device during a conversation situation are often fast and barely perceptible to the user himself, and this means that fluctuations in the signal level from the binaural hearing device are correspondingly brief, the auditory perception by the user can be significantly impaired, and, particularly on account of the relatively high concentration that is required as a result of the fluctuations in the sound level, may even be perceived as disagreeable.

Published, non-prosecuted German patent application DE 10 2013 207 149 A1 discloses a hearing aid system having at least two hearing aids and also a method for operation of said hearing aid system. The hearing aid system contains particularly a signal processing apparatus for processing audio signals and a signal connection for transmitting a first audio signal from each hearing aid to the signal processing apparatus. The signal processing apparatus rates a signal component from the preferential direction in relation to the head of the wearer in the first audio signals, and the signal processing device uses the first audio signals to produce a first binaural directional microphone signal and sets the directional characteristic thereof on the basis of the rating. In this situation, other useful signals, e.g. vocal contributions in a discussion, are prevented from being suppressed.

Published, European patent application EP 2 928 210 A1 proposes a binaural hearing system, containing a left and a right hearing aid, with noise suppression and with a user interface. The left and right hearing aids contain at least two input units that, in a number of frequency bands and time entities, provide a representation of an input signal in the time domain, and a noise suppression system having a multichannel "beamformer" that is connected to the input units and produces a directional signal. The wearer of the hearing system can use the user interface to prescribe directivity for a target signal.

SUMMARY OF THE INVENTION

The invention is based on the object of specifying for a binaural hearing device a method that, in a hearing situation with a main sound source against a noisy background, prevents fluctuations in the signal level on the basis of relative movements by the main sound source in relation to a user of the binaural hearing device as quickly and efficiently as possible.

The invention achieves the cited object by method for signal processing in a binaural hearing device having a first hearing aid and a second hearing aid. The first hearing aid has a first microphone for producing a first signal and a first sound generator, and the second hearing aid has a second microphone for producing a second signal and a second sound generator. The first signal and the second signal are taken as a basis for at least approximately ascertaining a direction of a main sound source. A deviation in the direction of the main sound source from a frontal direction of the binaural hearing device prompts the hearing aid that is closer to the main sound source in each case to be defined as the local hearing aid and the hearing aid that is more remote from the main sound source to be defined as the remote hearing aid.

In this case, in the local hearing aid, at least in one frequency band, the first signal is filtered using at least one first angle-dependent filter, that is to say by applying an angle-dependent filter factor, and this produces a filtered first signal. The first signal and/or the second signal and/or the direction of the main sound source is/are taken as a basis for determining an adaptation coefficient. An adapted first signal is produced from the first signal and the filtered first signal on the basis of the adaptation coefficient, and a local directional characteristic of a reproduction signal that is to be output by the sound generator of the local hearing aid is determined from the adapted first signal and the second signal. Refinements that are advantageous and in some cases inventive in themselves are the subject matter of the sub-claims and of the description below.

In this context, at least approximate ascertainment of the direction of the main sound source is intended to be understood to mean particularly that a plurality of angle ranges are determined or prescribed and that the angle ranges with which the direction of the main sound source can be associated are ascertained. In particular, this can involve one of the angle ranges being associated with the frontal direction of the binaural hearing device, and hence containing a zero angle on the angle scale on which the division into the angle ranges is based. In this case, a deviation in the direction of the main sound source from the frontal direction of the binaural hearing device can occur by virtue of the direction of the main sound source being associated with a different angle range than the one corresponding to the frontal direction. In this case, the frontal direction of the binaural hearing device can be defined preferably by the plane of symmetry of the two hearing aids during operation when worn properly by the user.

In particular, it is also possible for a frontal angle range and a right and left deviation range to be defined in this case, so that the approximate determination of the direction of the main sound source in this case means the association of the main sound source either with the frontal angle range or with one of the two deviation ranges. Filtering of the first signal using at least one angle-dependent first filter factor particularly includes multiplication of the first signal by an angle-dependent first filter factor in a relevant frequency band. However, the first signal can likewise also be convoluted with a vector-value filter factor in the time domain or in a frequency domain, in order to produce the first filtered signal.

To determine the adaptation coefficient in a frequency band, the first signal needs to be associated either with the local hearing aid or with the remote hearing aid, and the second signal needs to be associated with the hearing aid that then remains. The adaptation coefficient in a local hearing aid specifies whether and, if need be, to what extent in the local hearing aid a first signal needs to be adapted to suit the second signal by producing the first adapted signal from the first signal and the first filtered signal. By way of example, this involves the first adapted signal being formed by mixing the first signal and the first filtered signal, e.g. in the form of a weighted sum. In particular, the first adapted signal will be formed by a convex sum of the first signal and the first filtered signal with the adaptation coefficient as convexity parameter. In this case, the adaptation coefficient lies between 0 and 1, the first filtered signal being forwarded directly for a value of 1, corresponding to complete adaptation of the first signal, whereas no adaptation takes place for a value of 0.

In this case, the angle-dependent first filter factor that is used to filter the first signal in order to produce the first filtered signal takes account of the fact that, in the case of a deviation in the direction of the main sound source from the frontal direction, a minimum time shift caused by the propagation time difference firstly arises between the first signal and the second signal. This shift can initially be approximated as a phase shift. In addition, secondly, shadowing effects arise in the cited case of the angular deviation as result of the head of the user of the binaural hearing device, as result of which the remote hearing aid has a weaker signal level. The filtering of the first signal using the first filter factor compensates for the phase difference and the volume differences between the first signal and the second signal for the direction of the main sound source, as result of which the main sound source can initially be considered to be a frontal source for the further signal processing in the local hearing aid on account of the aligned level and the aligned phase in the first signal and in the second signal.

In a hearing situation for the user of the binaural hearing device in which a voice signal from an interlocutor needs to be reproduced as clearly as possible while background noise, such as other voice signals, need to be suppressed as far as possible, the binaural directional characteristic is in most cases oriented very narrowly to the front in order to reduce the undesirable sound signals as result of the lower sound sensitivity in those directions that do not correspond to the voice signal from the interlocutor, which is considered to be the useful signal. Since the binaural directional characteristic, that is to say the directional characteristic formed on the basis of signal components from the two microphones, is now formed in the reproduction signal from one of the sound generators at a time, on the basis of the first adapted signal and the second signal, and the directional deviation of the main sound source from the frontal direction has effectively been corrected in the two cited signals, a voice signal from an interlocutor is no longer attenuated by the narrow binaural directional characteristic given relative movements between the interlocutor and the user of the binaural hearing device.

In the case of such relative movements as can arise as result of brief head movements by the user of the binaural hearing device or as a result of spontaneous gestures by the interlocutor, the interlocutor is, in simple terms, always "returned to the frontal direction" by virtue of the adaptation of the first signal to suit the second signal. A particular advantage in this case is that the adaptation of the first signal to suit the second signal, which corrects the effects of the relative movements between the user and an interlocutor, can be effected regardless of the formation of the binaural directional characteristic, and hence does not influence the algorithm of the latter.

If need be, after the formation of the binaural directional characteristic in the local hearing device from the first adapted signal and the second signal, the reproduction signal can still be appropriately reworked in order to achieve as realistic as possible a spatial perception of the signal from the main sound source.

Preferably, the approximate direction of the main sound source and/or the adaptation coefficient is/are ascertained in at least one frequency band on the basis of the signal levels of the first signal and the second signal. In particular, this can be affected on a frequency band by frequency band basis, with only a subset of frequency bands being used for the final determination of the direction of the main sound source. Direction determination on the basis of the differences in the level of the first signal and of the second signal can be implemented particularly simply and quickly. In particular, it is also possible for the signal level of the sum of the first signal and the second signal to be used in order to be able to take account of any phase cancellation effects too.

Alternatively, in at least one frequency band, the value of an angle-dependent second filter factor can be prescribed at least for a left deviation angle, a zero angle and a right deviation angle. A signal can be selected from the first signal and the second signal and needs to be multiplied by the second filter factor for the purpose of orientation, which produces a respective oriented signal. An angle-dependent interference power can be ascertained from the difference between the oriented signal and the other signal, and an angle-dependent total power can be ascertained from the sum of the oriented signal and the other signal. A normalized angle-dependent interference power can be ascertained from the angle-dependent interference power and the angle-dependent total power, and a comparison of the normalized angle-dependent interference powers can be taken as a basis for ascertaining the approximate direction of the main sound source and/or an adaptation coefficient at least for the left deviation angle, the zero angle and the right deviation angle.

In this case, prescribing the second filter factor for a left deviation angle, a zero angle and a right deviation angle corresponds to splitting the space into three angle ranges, the direction of the main sound source being determined approximately by classification into one of the three angle ranges. This classification is now performed as described below.

Since the selected signal is multiplied by the second filter factor—at least for the left deviation angle, the zero angle and the right deviation angle in each case—it is oriented in line with the other signal. In this case, this orientation is effected such that, for the angle that is used as a parameter in the angle-dependent second filter factor, the two signals do not have any significant phase and volume differences. If the difference is now formed from the oriented signal and the other signal, then any sound signal from that direction that is used as an angle parameter in the second filter factor is approximately cancelled out. For this angle, the angle-dependent interference power is close to zero.

So as now to be able to compare the angle-dependent interference power for the three cited angle ranges with one another, the interference power still needs to be normalized beforehand using the total power that is formed from the summed signal containing the adapted signal and the other signal. In this case the angle-dependent interference power and the angle-dependent total power preferably need to be computed as the absolute value or square of the absolute value of the difference or the sum of the oriented signal and the other signal.

The direction of a main sound source can then be identified as that direction in which the normalized angle-dependent interference power is at a minimum. A priori, this can also be performed for more than three angle ranges, but for most applications it is sufficient to distinguish between the frontal region and two deviation regions distributed symmetrically to the left and right.

A further advantage in this case is found to be when, in a plurality of frequency bands, the comparison of the normalized angle-dependent interference powers is taken as a basis in each case for determining a frequency-band-dependent direction parameter at least for the left deviation angle, the zero angle and the right deviation angle, wherein the approximate direction of the main sound source is ascertained from the frequency-band-dependent direction parameters. By way of example, this can be affected by a possibly weighted mean value of the direction parameters. Preferably, determination of the direction of the main sound source is performed only in those frequency bands in which a significant directional dependency of the sound signal from the main sound source can be expected. By using direction parameters from multiple frequency bands, it is possible to compensate for or minimize errors in the direction determination, which can arise on account of fluctuations, for example.

Preferably, the first filter factor for producing the first filtered signal and the second filter factor have the same frequency dependency for the respective frequency band and have the same angle dependency at least for the left deviation angle, the zero angle and the right deviation angle. This means that adapting the first signal to suit the second signal, that is to say angle-dependent orientation, involves the use of filter factors having the same functional dependency as for ascertaining the direction of the main sound source.

In an advantageous refinement of the invention, in the local hearing aid, a first filtered signal is produced in each of a plurality of frequency bands and the first filtered signal is taken as a basis for producing a first adapted signal, wherein, as the frequency of the frequency band for producing the first filtered signal for the first filter factor rises, the angle increases monotonously in each case in the direction of the main sound source. What is meant by a monotonous increase is particularly that the angle that is used for the first filter factor can be chosen to be constant for multiple successive frequency bands, with a smaller angle for the first filter factor being chosen for a group of low frequency bands and a larger angle for the first filter factor being chosen for a group of higher frequency bands. This takes account of the circumstance that the directional dependency of signal components in lower frequency bands is usually lower, which means that the need for angle-dependent adaptation has less of an effect in this case than in higher frequency bands, in which standard useful signal components has a much higher directional dependency that should preferably be taken into account.

Expediently, the absolute value of the first filter factor is $\leq 1$ in each case. This is favorable particularly for the case in which the first signal, which can be adapted to suit the second signal by the first filter factor, is formed by the signal from the local hearing aid. The signal that is recorded by the microphone of the remote hearing aid has a lower volume level on account of shading effects due to the head of the user. This is represented by a first filter factor, the absolute value of which is chosen to be $\leq 1$. The first filtered signal undergoes no raising of the level as result of the filtering process. The selection concerning whether the signal from the microphone of the local hearing aid or the signal from the microphone of the remote hearing aid is to be chosen as the first signal that needs to be adapted to suit the second signal can be made particularly on the basis of the current hearing situation in this case. Specifically in noisy surroundings, the "local signal" preferably needs to be adapted to suit the "remote signal", since, in this case, the adaptation process does not raise the level of the signal still further, which means that oversaturation can be avoided.

A further advantage is found to be when, in a reproduction signal for the local hearing device, the first angle-dependent filter factor and/or the adaptation coefficient is/are taken as a basis for performing compensation for a volume and a phase difference when the first signal is produced by the microphone of the local hearing aid. In this case of adaptation, the "local signal" is effectively provided with the phase and volume reference of the remote hearing aid in the local hearing aid. For the reproduction signal from the local hearing aid, this referencing to the remote hearing aid needs to be compensated for in order to be able to obtain a spatial perception that is as realistic as possible for the user of the hearing aid.

The invention further cites a binaural hearing device having a first hearing aid and a second hearing aid. The first hearing aid has a first microphone for producing a first signal and a first sound generator, and the second hearing aid has a second microphone of a second signal and a second sound generator. At least one signal processing unit is provided that is set up to perform the method described above. The advantages cited for the method and developments thereof can be applied to the binaural hearing device mutatis mutandis in this case.

Other features which are considered as characteristic for the invention are set forth in the appended claims.

Although the invention is illustrated and described herein as embodied in a method for signal processing in a binaural hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Corresponding parts and parameters are provided with the same reference symbols throughout the figures.

Figure 1A:
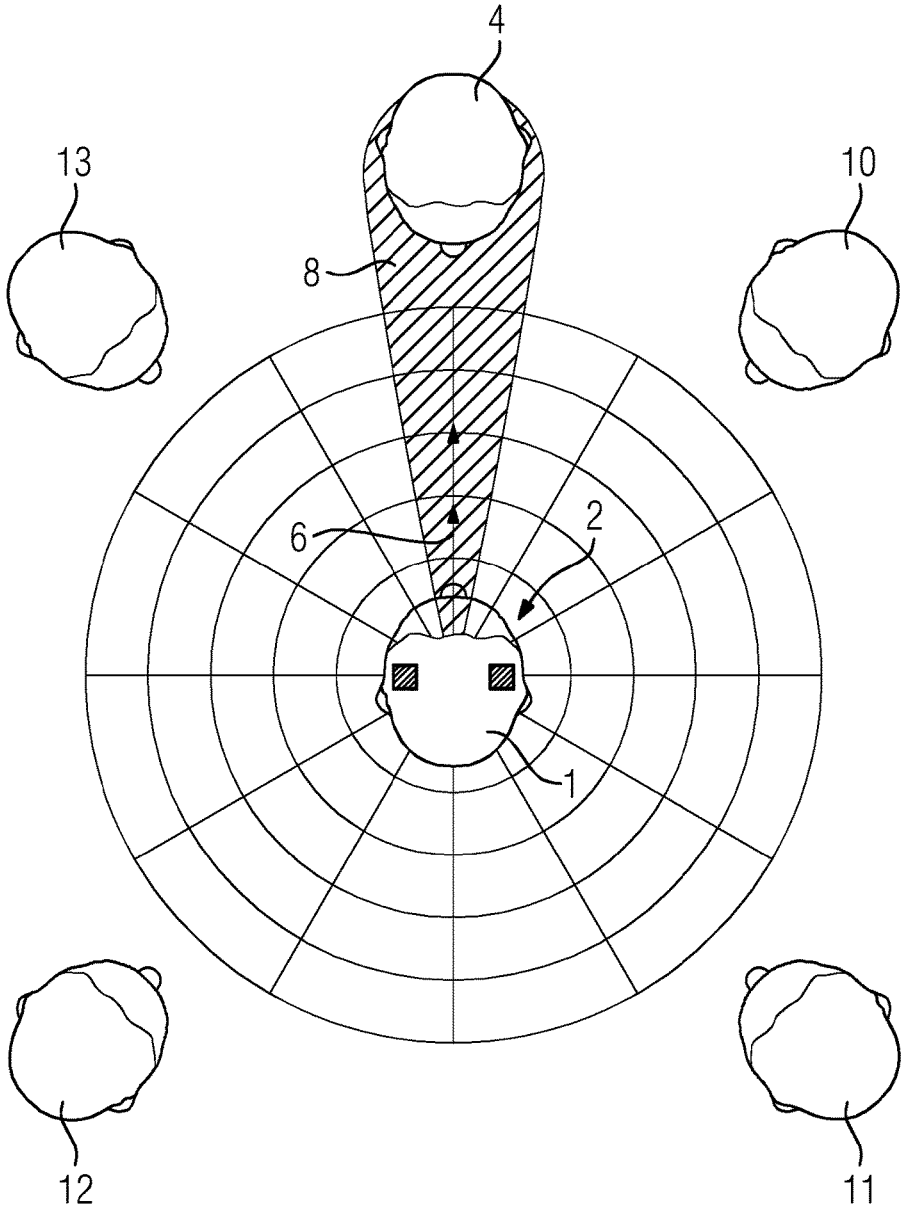
FIGS. 1A-1C show diagrammatic, plan views of a user of a binaural hearing device in a conversation situation with an interlocutor.
Figure 1B:
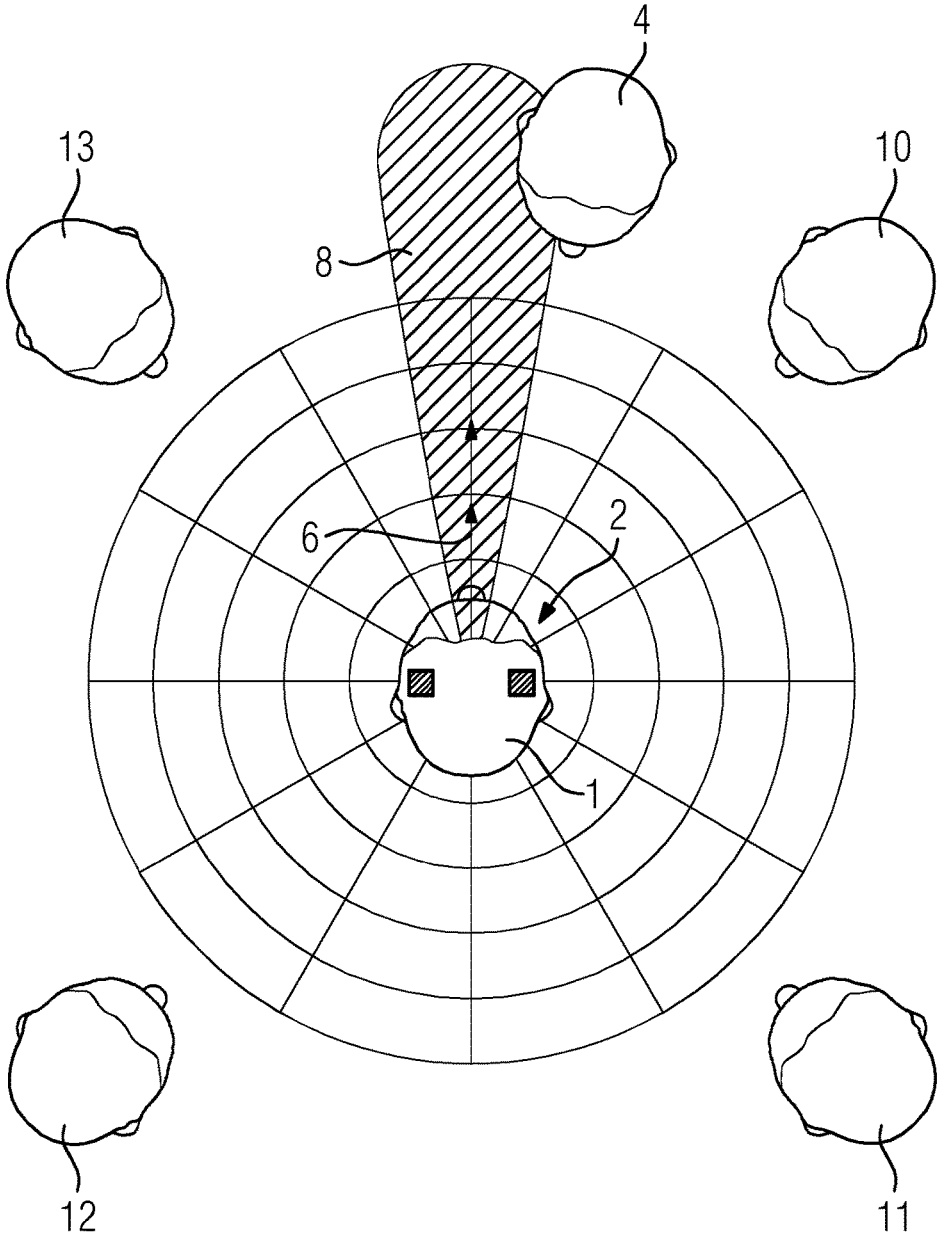
Figure 1C:
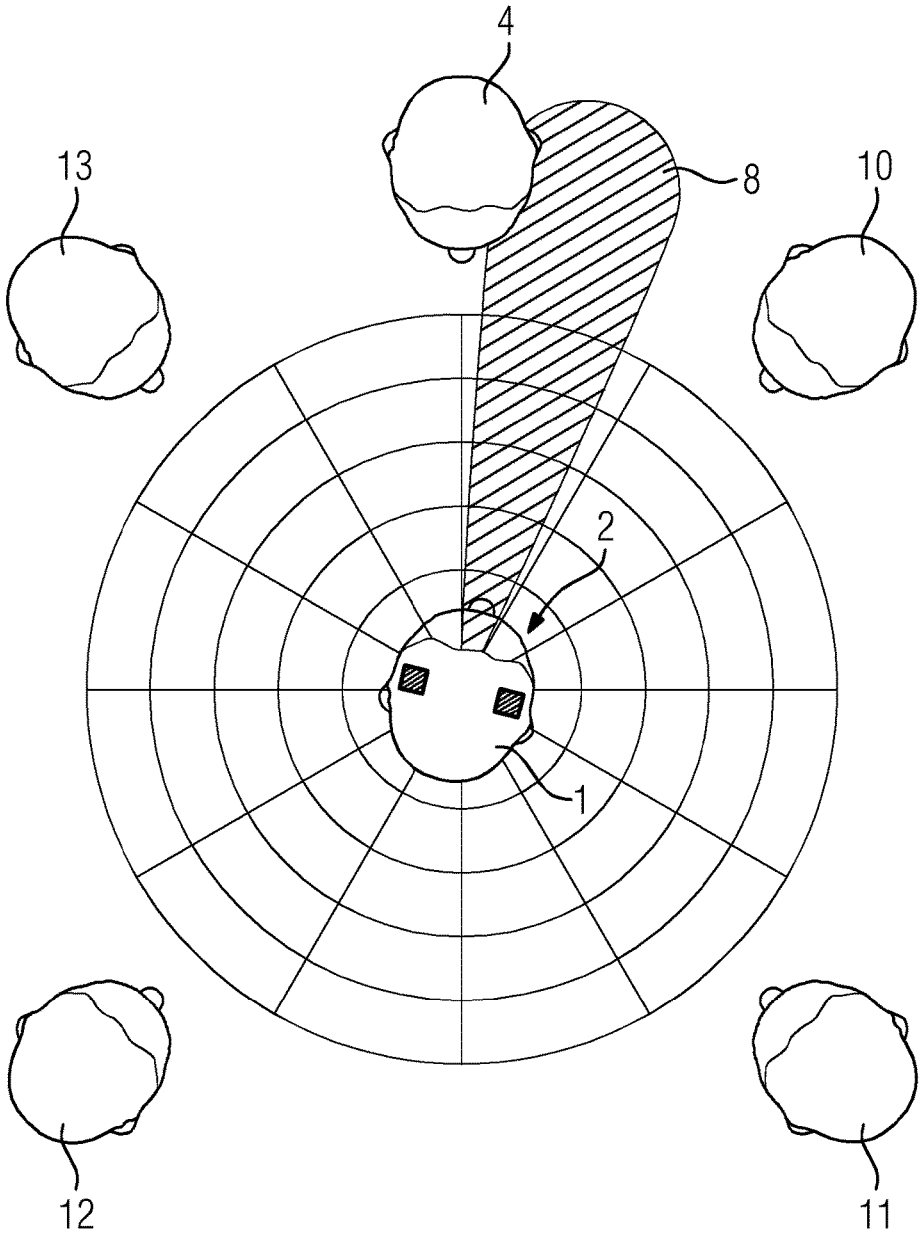

The influence of the movements of a user of the binaural hearing device in a conversation, or of the movements of an interlocutor, on the signal level of the voice signal from the interlocutor is shown in FIGS. 1A to 1C. FIG. 1A shows a user 1 of a binaural hearing device 2 who is in a conversation with an interlocutor 4. In this case, the interlocutor 4 is positioned in a frontal direction 6 of the user 1. Owing to the narrow directional characteristic 8 of the binaural hearing device, interjections from the other interlocutors 10 to 13 are barely perceived by the user 1. In FIG. 1B, the main interlocutor 4 of the user 1 has moved slightly to the side, for example owing to a relieving movement. If the user 1 now follows the movement of the interlocutor 4 not directly by changing his line of vision but rather only with his eyes, this results in the voice signal from the main interlocutor 4 being slightly attenuated on account of the movement of the main interlocutor within the directional characteristic 8 of the binaural hearing device 2. There is a similar occurrence in FIG. 1C, in which the user 1 turns his line of vision slightly while the main interlocutor 4 maintains his position. In this case too, the result is that the relative movement means that the main interlocutor 4 is no longer positioned in the center of the directional characteristic 8, as result of which his voice signal undergoes attenuation.

Figure 2:
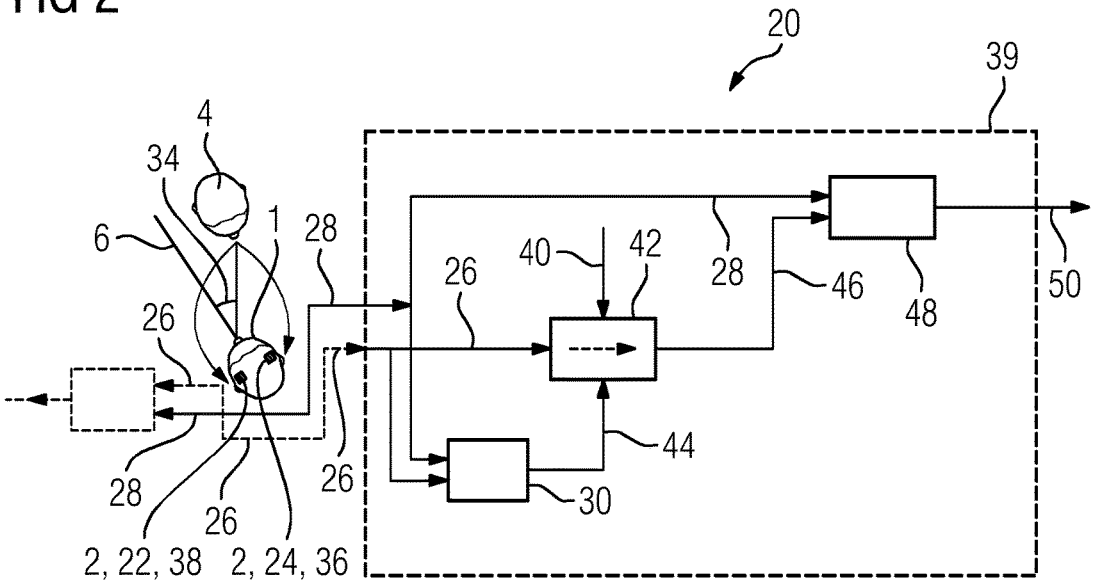
FIG. 2 is a block diagram of a flow of a method for direction-dependent adaptation of signals in the binaural hearing device for the conversation situation shown in FIG. 1.

FIG. 2 schematically shows a block diagram of the flow of a method 20 for signal processing in a binaural hearing device 2. The binaural hearing device 2 contains a first hearing aid 22 and a second hearing aid 24, which each contain a microphone, which is not shown in the drawing. The microphone of the first hearing aid 22 produces a first signal 26 from sound, and the microphone of the second hearing aid 24 correspondingly produces a second signal 28. On the basis of the first signal 26 and the second signal 28, a direction identifier 30 can establish that the interlocutor 4 of the user 1, who in this case forms the main sound source 32, is not oriented in the frontal direction 6 of the user 1 but rather has a certain angular deviation 34 relative thereto. As result of this angular deviation 34, the second hearing aid 24, which is closer to the interlocutor 4, is defined as the local hearing aid 36, while the first hearing aid 22, which is more remote from the interlocutor 4, is defined as the remote hearing aid 38. In the individual frequency bands 39, the first signal 26 is now multiplied by a first filter factor 40 each time in the local hearing aid 36, as result of which a first filtered signal 32 is first produced.

In the direction identifier 30, the direction of the interlocutor 4 is taken as a basis for determining an adaptation coefficient 44, and then a first adapted signal 46 is produced from the first signal 26, the first filtered signal 42 and the adaptation coefficient 44. In this case, the first adapted signal 46 is formed as a weighted overlay containing the first filtered signal 42 and the first signal 26, for example, the adaptation coefficient 44 being used for the weighting. The first adapted signal 46 and the second signal 28 are then used to form the directional characteristic 48 that the reproduction signal 50 that is to be output via the sound generator of local hearing aid 36 needs to have in the relevant frequency band.

Figure 3:
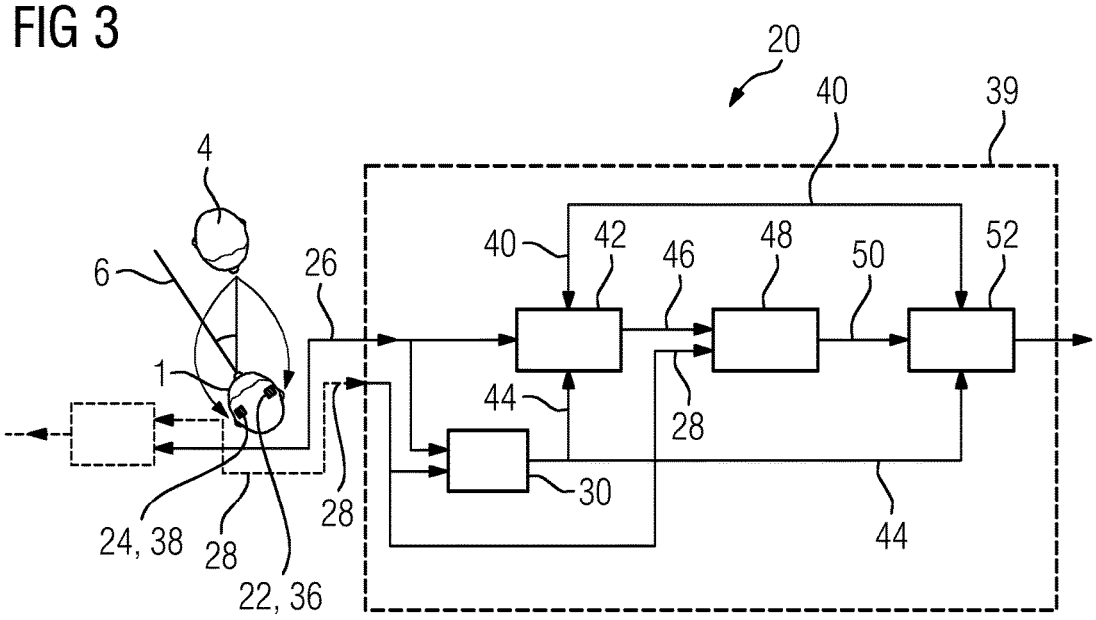
FIG. 3 is a block diagram of a further refinement of the method shown in FIG. 2.

FIG. 3 shows an alternative refinement of the method 20 shown in FIG. 2. In the case that exists here, the local hearing aid 36 can be associated with the first hearing aid 22, while the remote hearing aid 38 can be associated with the second hearing aid 24. In this case too, the first signal 26 is adapted to suit the second signal 28 by virtue of the first signal 26 first of all being multiplied by a first filter factor 40 on a frequency band by frequency band basis, which produces a filtered first signal 42 that is used by means of the adaptation coefficient 40 that was determined in the direction identifier 30 to form the first adapted signal 46. The first adapted signal 46 is then used with the second signal 28 as an input variable in the forming directional characteristic 48. Since the first hearing aid 22 selected in this case was the local hearing aid 36 that is closer to the interlocutor 4 of the user 1, but the first signal 26 is being adapted in respect of the reference of the remote hearing aid 38, the adaptation coefficient 44 and the first filter factor 40 can be used to perform compensation 52 for the volume and the phase difference on the reproduction signal 50 in order to restore the spatial perception as far as possible.

Figure 4:
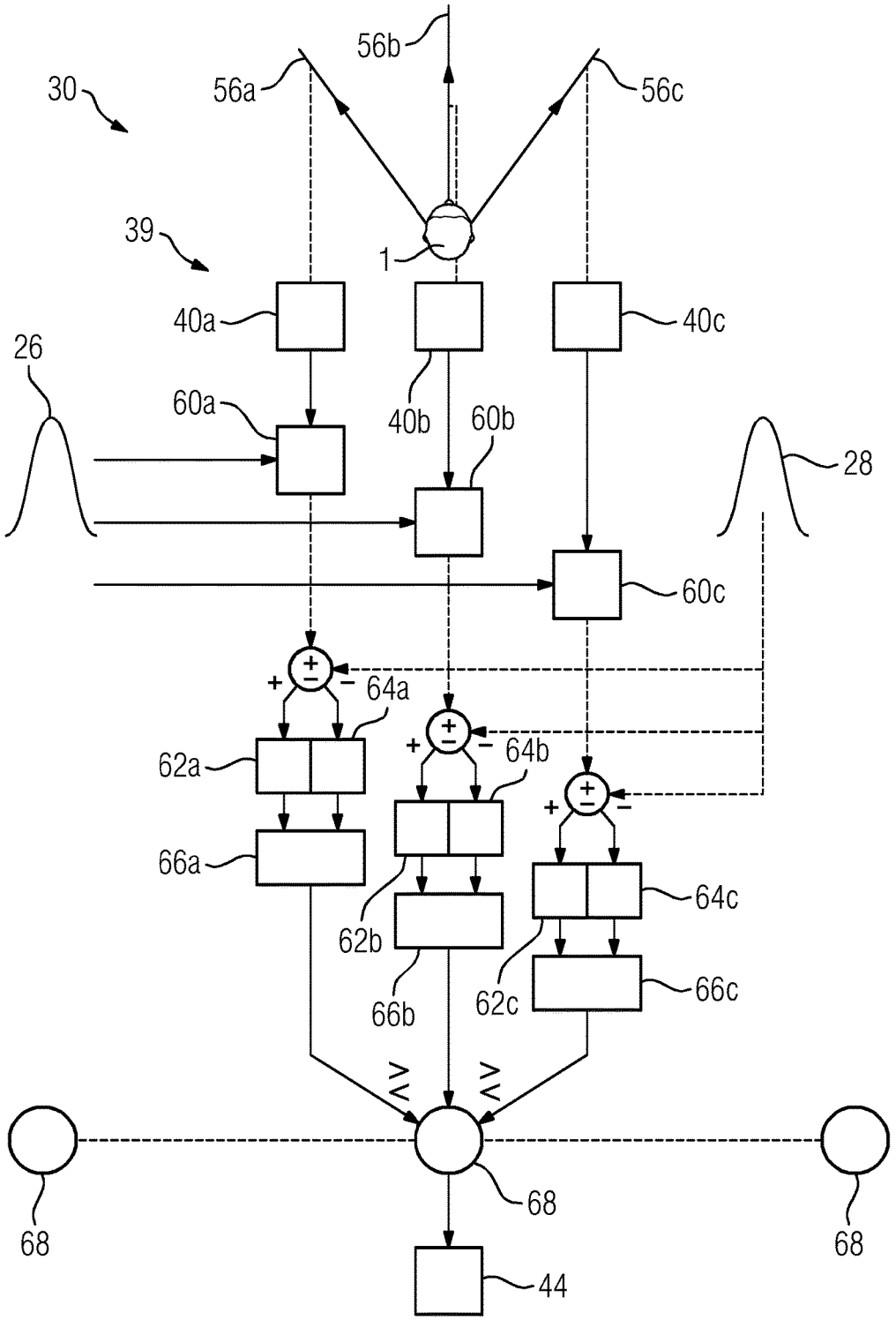
FIG. 4 is a block diagram of an approximate determination of a direction of an interlocutor using an angle-dependent interference power.

FIG. 4 shows a block diagram of an approximate direction determination 30 for the voice signal from an interlocutor, who is not shown in more detail. For the space in front of the user 1 of the binaural hearing device, a left deviation angle 56*a*, a zero angle 56*b* and a right deviation angle 56*c* are prescribed, which divides the space in front of the user into three angle ranges. For the left deviation angle 56*a*, the zero angle 56*b* and the right deviation angle 56*c*, angle-dependent second filter parameters 40*a*, 40*b*, 40*c* are prescribed each time in a frequency band 39. In this case, these can have the same angle dependency as the first filter parameter 40 in the respective frequency band 39. From the first signal 26 and the second signal 28, one signal in this case the first signal 26, is selected that needs to be oriented to the other signal, that is to say in this case the second signal 28.

To this end, the first signal 26 is first of all multiplied by the respective second filter parameter 40*a*, 40*b*, 40*c* for each of the cited angles 56*a*, 56*b*, 56*c*, as result of which an angle-dependent oriented signal 60*a*, 60*b*, 60*c* is formed in each case. For each of the cited angles 56*a*, 56*b*, 56*c*, an angle-dependent interference power 62*a*, 62*b*, 62*c* and an angle-dependent total power 64*a*, 64*b*, 64*c* are now formed from the oriented signal 60*a*, 60*b*, 60*c* with the second signal by difference and sum formation. The angle-dependent interference power 62*a*, 62*b*, 62*c* is normalized in each case by dividing the associated angle-dependent total power 64*a*, 64*b*, 64*c* thereby, as result of which a normalized angle-dependent interference power 66*a*, 66*b*, 66*c* is obtained for each of the angles 56*a*, 56*b*, 56*c* from the first signal 26 and the second signal 28.

The normalized angle-dependent interference powers 66*a*, 66*b*, 66*c* are then compared with one another. The orientation of the first signal 26 to the second signal 28 is such that a sound that comes each time from the direction of the angle 56*a*, 56*b*, 56*c* used for orientation does not lead to a significant angle-dependent interference power 62*a*, 62*b*, 62*c* on account of the difference formation. Therefore, a direction parameter 68 that is used for approximate direction determination for the voice signal from the interlocutor can be ascertained on the basis of that angle among the left deviation angle 56*a*, the zero angle 56*b* and the right deviation angle 56*c* for which the normalized angle-dependent interference power 66*a*, 66*b*, 66*c* is at a minimum. On the one hand, the direction parameter 68 can then be used in the relevant frequency band directly to determine the adaptation coefficient 44, and on the other hand, direction parameters 68 for multiple frequency bands 39 can be averaged in order to use this to associate the voice signal from the interlocutor, which is the main sound signal for the user 1, with one of the three cited angles.

Figure 5A:
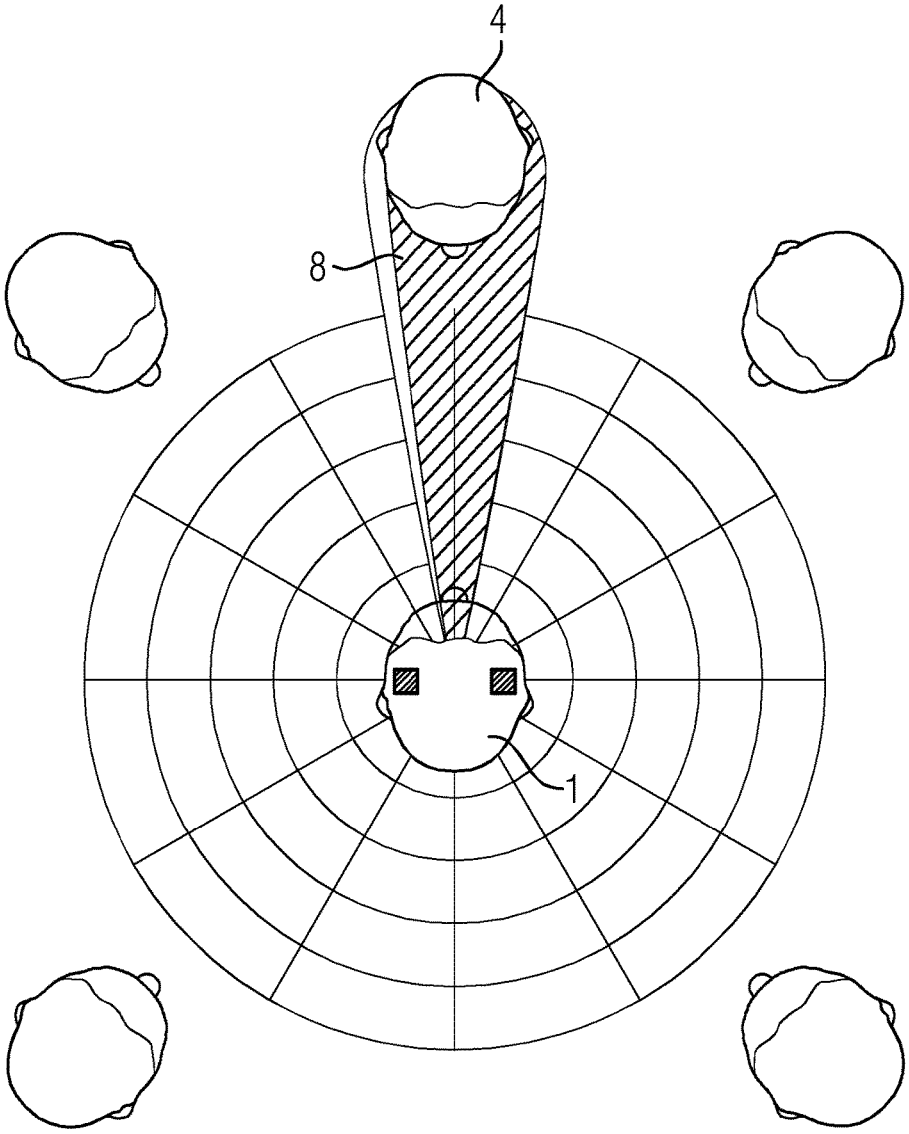
FIGS. 5A-5C are plan views of adapted directional characteristics of the binaural hearing device in the conversation situation shown in FIG. 1A-1C.
Figure 5B:
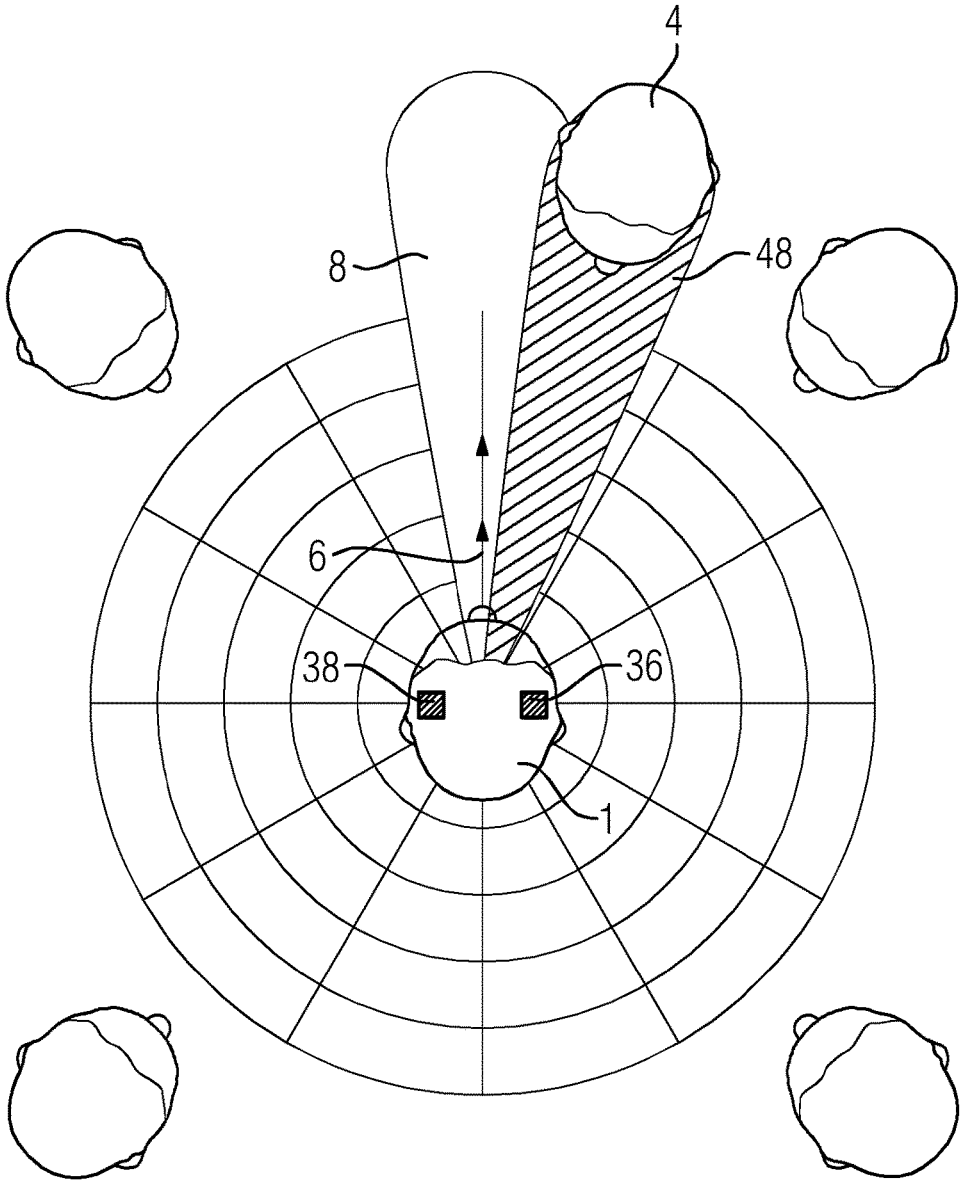
Figure 5C:
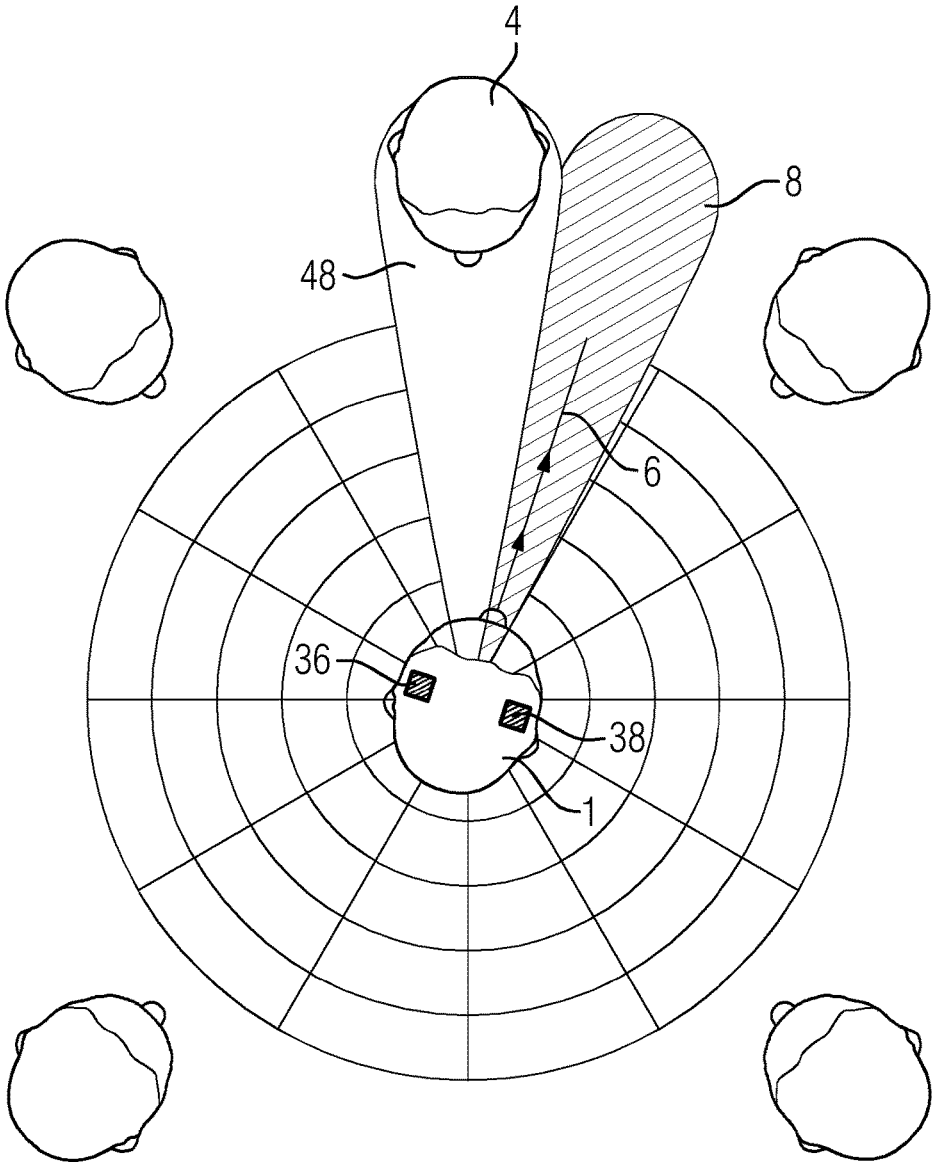

FIGS. 5A-5C each show a plan view of the conversation situation shown in FIGS. 1A-1C and the adaptations of the directional characteristics 8, 48 to suit the movements of the interlocutor 4 and to suit the movements of the user 1. In FIG. 5A, the interlocutor 4 is standing head-on to the user; an adaptation of the directional characteristics 8 is not necessary. In FIG. 5B, the interlocutor 4 has made a slight sideways movement. The local directional characteristic 48 of the local hearing aid 36 follows this movement, while the directional characteristic 8 of the remote hearing aid 38 continues to be oriented in the frontal direction 6. As result, the voice signal from the interlocutor continues to be captured well by the local directional characteristic 48, whereas the shift in respect of the directional characteristic 8 of the remote hearing aid 38 means that the voice signal is attenuated in the reproduction signal therefrom. A similar situation is shown in FIG. 5C, in which the user 1 has now slightly turned his frontal direction 6 relative to the interlocutor 4. The local directional characteristic 48 of the local hearing aid does not follow this turn, however, but rather continues to be oriented to the interlocutor 4, so that the voice signal from the latter does not experience any kind of attenuation in the reproduction signal from the local hearing aid 36.

Although the invention has been illustrated and described in more detail by the preferred exemplary embodiment, the invention is not restricted by this exemplary embodiment. Other variations can be derived therefrom by a person skilled in the art without departing from the scope of protection of the invention.

The following is a summary list of reference numerals and the corresponding structure used in the above description of the invention:

1 User
2 Binaural hearing device
4 Interlocutor
6 Frontal direction
8 Directional characteristic
10-13 Interlocutor
20 Method
22 First hearing aid
24 Second hearing aid
26 First signal
28 Second signal
30 Direction identifier
32 Main sound source
34 Angular deviation
36 Local hearing aid
38 Remote hearing aid
39 Frequency band
40 First filter factor
40*a-c* Second filter factor
42 First filtered signal
44 Adaptation coefficient
46 First adapted signal
48 Local directional characteristic
50 Reproduction signal
52 Compensation
56*a* Left deviation angle
56*b* Zero angle
56*c* Right deviation angle
60*a-c* Oriented signal
62*a-c* Angle-dependent interference power
64*a-c* Angle-dependent total power
66*a-c* Normalized angle-dependent interference power
68 Direction parameter

The invention claimed is:

1. A method for signal processing in a binaural hearing device having a first hearing aid and a second hearing aid, the first hearing aid having a first microphone for producing a first signal and a first sound generator, the second hearing aid having a second microphone for producing a second signal and a second sound generator, which comprises the steps of:

taking the first signal and the second signal as a basis for at least approximately ascertaining a direction of a main sound source, a deviation in the direction of the main sound source from a frontal direction of the binaural hearing device prompting the hearing aid that is closer to the main sound source in each case to be defined as a local hearing aid and the hearing aid that is more remote from the main sound source to be defined as a remote hearing aid;

filtering one of the first signal and the second signal in the local hearing aid, at least in one frequency band, using at least one angle-dependent first filter factor, thus producing a first filtered signal;

taking at least one of the first signal, the second signal or the direction of the main sound source as a basis for determining an adaptation coefficient;

producing a first adapted signal from one of the first and second signals and the first filtered signal on a basis of the adaptation coefficient; and determining a local directional characteristic of a reproduction signal that is to be output by the sound generator of the local hearing aid from the first adapted signal and one of the first and second signals.

2. The method according to claim 1, which further comprises ascertaining an approximate direction of at least one of the main sound source or the adaptation coefficient in the at least one frequency band on a basis of signal levels of the first signal and the second signal.

3. The method according to claim 1, prescribing, in the at least one frequency band, a value of an angle-dependent second filter factor at least for a left deviation angle, a zero angle and a right deviation angle;

selecting a signal from the first signal and the second signal and needs to be multiplied by the angle-dependent second filter factor for a purpose of orientation, which produces an oriented signal;

ascertaining an angle-dependent interference power from a difference between the oriented signal and the other signal of the first and second signals;

ascertaining an angle-dependent total power from a sum of the oriented signal and the other of the first and second signals;

ascertaining a normalized angle-dependent interference power from the angle-dependent interference power and the angle-dependent total power; and taking a comparison of the normalized angle-dependent interference powers as a basis for ascertaining the approximate direction of at least one of the main sound source or the adaptation coefficient at least for the left deviation angle, the zero angle and the right deviation angle.

4. The method according to claim 3, which further comprises:

taking, in a plurality of frequency bands, a comparison of the normalized angle-dependent interference powers as a basis in each case for determining a frequency-band-dependent direction parameter at least for the left deviation angle, the zero angle and the right deviation angle; and ascertaining the approximate direction of the main sound source from the frequency-band-dependent direction parameters.

5. The method according to claim 3, wherein a first filter factor of the angle-dependent first filter factor for producing the first filtered signal and a second filter factor of the angle-dependent second filter factor have a same frequency dependency for a respective frequency band and have a same angle dependency at least for the left deviation angle, the zero angle and the right deviation angle.

6. The method according to claim 5, which further comprises producing, in the local hearing aid, the first filtered signal in each of a plurality of frequency bands and the first filtered signal is taken as a basis for producing the first adapted signal and wherein, as a frequency of the frequency band for producing the first filtered signal for the first filter factor rises, an angle increases monotonously in each case in the direction of the main sound source.

7. The method according to claim 5, wherein an absolute value of the first filter factor is $\leq 1$ in each case.

8. The method according to claim 5, wherein in the reproduction signal for the local hearing aid, at least one of the first filter factor or the adaptation coefficient is taken as a basis for performing compensation for a volume and a phase difference when one of the first and second signals is produced by the microphone of the local hearing aid.

9. A binaural hearing device, comprising:

a first hearing aid having a first microphone for producing a first signal and a first sound generator;

a second hearing aid having a second microphone for producing a second signal and a second sound generator; and at least one signal processing unit programmed to perform a method according to claim 1.

* * * * *